US005415111A

United States Patent [19]

Lewnard et al.

[11] Patent Number: 5,415,111

[45] Date of Patent: May 16, 1995

[54] CIRCULATING FLUIDIZED BED COMBUSTOR WITH BOTTOM ASH RE-INJECTION

[75] Inventors: John J. Lewnard, Emmaus; Tsun-Chiu R. Tsao, Allentown, both of Pa.; Alan Anderson, Modesto; Michael Bryant, Stockton, both of Calif.

[73] Assignee: Air Products and Chemicals, Inc., Allentown, Pa.

[21] Appl. No.: 179,651

[22] Filed: Jan. 7, 1994

[51] Int. Cl.[6] ..... F23G 5/02

[52] U.S. Cl. ..... 110/222; 110/245; 122/4 D

[58] Field of Search ..... 110/245, 222; 122/4 D

[56] References Cited

U.S. PATENT DOCUMENTS

| | | | |
|---|---|---|---|
| 4,041,906 | 8/1977 | Edwards | 110/222 |
| 4,259,911 | 4/1981 | Jones | 122/4 D |
| 4,325,327 | 4/1982 | Kantesaria et al. | 110/245 |
| 4,416,418 | 11/1983 | Goodstine et al. | 110/245 |
| 4,552,203 | 11/1985 | Chrysostome et al. | 110/245 |
| 4,648,332 | 3/1987 | Goedhart | 110/245 |
| 4,733,621 | 3/1988 | Kostamo et al. | 110/245 |
| 4,829,912 | 5/1989 | Alleston et al. | 110/345 |
| 4,981,111 | 1/1991 | Bennett et al. | 110/347 |

*Primary Examiner*—Henry C. Yuen
*Attorney, Agent, or Firm*—Robert J. Wolff

[57] ABSTRACT

A process is set forth for directly controlling the quantity and particle size distribution of the solid inventory inside a circulating fluidized bed combustor. A portion of the bed ash is withdrawn from the combustor as bottom ash. The particle size distribution of the stream is adjusted, such as by a hammermill, to a specified distribution. Finally, a portion of the adjusted ash is re-injected into the combustor. The process may be facilitated by size classifying the bottom ash prior to size reduction.

4 Claims, 1 Drawing Sheet

CIRCULATING FLUIDIZED BED COMBUSTOR WITH BOTTOM ASH RE-INJECTION

TECHNICAL FIELD

The present invention relates to a process for the combustion of a hydrocarbon fuel in a combustion zone and, more particularly, to a method for improving the solids inventory in the combustion zone of a circulating fluidized bed combustor.

BACKGROUND OF THE INVENTION

Operation of a combustion zone such as that found in a circulating fluidized bed combustor requires that the inventory of solids in the combustion zone be maintained at a specified level. The particle size distribution of the bed material in the combustion zone is also critical for proper operation. Because the feed, typically a solid hydrocarbon material as the fuel and an alkaline material as an adsorbent for sulfur capture, contains non-combustible ash components, there is a constant need to withdraw ash from the combustion zone. Finer ash particles are typically elutriated from the combustion zone and lost as fly ash. The elutriation rate for fly ash is generally difficult to adjust, and tends to remain invariant for a given combustor design. Consequently, the quantity of bed inventory typically is maintained by adjusting the rate at which additional ash is withdrawn from the combustion zone. This material is usually designated as bottom ash. The particle size distribution of the bed material will generally be a consequence of the uncontrolled fly ash elutriation rate, and the intrinsic agglomeration and attrition rates of the feedstocks. It can be influenced indirectly by the feed size distributions and the bottom ash withdraw rate.

The conventional operating practice of controlling the inventory of solids through control of the bottom ash withdraw rate, coupled with a lack of direct control on the particle size distribution of the bed inventory, results in several problems. Due to the intense mixing inherent in the design of a circulating fluidized bed combustor, the bottom ash withdrawn from the combustion zone is typically well mixed; i.e. its composition is similar to that of the average bed inventory. This material will necessarily include some fuel and adsorbent particles, as well as inert ash particles. While it is desirable to remove the inert ash particles from the combustion zone, it is inevitable that some fuel and adsorbent particles will also be rejected. Consequently, the bottom ash can contain a significant amount of unreacted feedstock, i.e. fuel and adsorbent materials. Recent investigations have shown further that the coarser bottom ash particles are relatively rich in unreacted fuel. Adsorbent losses can also increase when large limestone particles are used for sulfur capture. As is known in the art, the sulfation of larger limestone particles tends to cause plugging of the exterior particle pores, leaving an interior region which is unreacted. Hence the current methods of controlling the solids inventory results in a loss of unreacted fuel and adsorbent, which increases the operating cost for feeds, as well as costs for ash disposal. In addition, these techniques do not allow direct control of the particle size distribution of the bed inventory.

A further problem in the operation of a circulating fluidized bed combustor is the need to selectively remove large particles from the solids inventory in the combustion zone. It is generally known in the art that excessively large particles in the bed inventory can be detrimental to operation, even in small concentrations. These particles contribute disproportionately to erosion in the lower portions of the combustion zone. In addition, their inherently reduced heat transfer characteristics can allow them to act as nucleation sites for agglomeration. Once the agglomeration process begins, its rate tends to increase exponentially with particle size. In severe cases, agglomeration can cause the process to shut down completely. Consequently, there is a need to be able to remove undesirable large particles that are fed or which may form in the combustion zone, even if they are present in small quantities. Because the current methods for bottom ash withdraw are generally not size specific, these procedures can only remove the harmful size fractions by gross purging of the solids inventory. This practice will usually require an excessively high bottom ash withdraw rate, which will deplete the bed inventory and adversely affect the process operation. Hence, current methods do not permit excessively large particles to be practically purged from the combustion zone.

Thus there is a need to be able to independently control the quantity of the solids inventory and the particle size distribution of the solids inventory to permit recovery of unreacted feedstocks from the bottom ash and selectively remove detrimental size fractions from the combustion zone. The use of this invention will meet this need, thereby providing several operational benefits for the operation of a combustion zone such as that found in a circulating fluidized bed combustor. It will decrease the amount of feed materials which are lost in the bottom ash, thus saving both feedstock costs and ash disposal. It will also permit control of the particle size distribution of the solids inventory independent of the quantity of bed inventory. Consequently, excessively large particles can be purged from the bed inventory without adverse operation effects. This feature will reduce erosion in the combustion zone, and provide a method for controlling agglomeration. In addition, it can extend the operability range of the technology to use certain types of fuels and adsorbents which were previously too difficult to utilize in these combustors because their ash content is either too low, resulting in an insufficient quantity of bed material; or their ash is too friable, resulting in the too fine a particle size distribution. With such feedstocks, it is difficult to establish or maintain the solids inventory without direct, independent control of the particle size distribution of the bed material.

The need to control both the quantity and particle size distribution of the solids inventory in a circulating fluidized bed combustor has lead to several techniques which tend to cause these two parameters to be coupled, as discussed above. The individual problems, such as feedstock losses, erosion control, and prevention of agglomeration are also addressed by several methods. Feedstock losses in the fly ash have been addressed in the prior art, including the use of fly ash re-injection taught in U.S. Pat. No. 4,981,111 by Bennett et al. Losses in the bottom ash are typically minimized by design and operation considerations. For example, the particle size distribution for the fuel and adsorbent is usually specified to reduce the amount of unreacted material rejected from the combustion zone. Size specifications for fuel and adsorbent can help to reduce losses in the bottom ash. However, other considerations, such as pressure drop through the combustor, heat transfer requirements, and combustor stability usually are also considered in the specification of feed size distribution. As a result, the feed size can not often be optimized to minimize feed losses in the bottom ash. Indeed, some losses through the bottom ash are inevitable due to the inherent mixing of the solid phase in a circulating fluidized bed combustor.

In some installations, bottom ash is classified, i.e. separated by size fraction, prior to final discharge from the combustion zone in an attempt to strip the finer particle sizes from the bottom ash stream. Usually these classifiers strip the finer particles by contacting them countercurrently with an air stream. See for example U.S. Pat. No. 4,829,912 by Alliston et al. While this technique reduces the losses associated with the finer particles in the bottom ash, it does not recover the fuel or adsorbent lost in larger particles. Depending on the nature of the feed and operating conditions, the feed losses in the larger particles in the bottom ash can be comparable or greater than the losses in the finer particles in the bottom ash.

There have been several investigations into recovering unreacted adsorbent from bottom ash. These typically involve a chemical treatment of the ash, such as contacting with alkali or hydration. The chemical action is used to increase the availability of adsorbent inside the bed particles to the gas phase reactants.

Erosion problems are usually handled by placing sacrificial or wear-resistant materials in erosion-sensitive areas of the combustion zone. Typical examples include spray coatings or refractory applied to heat transfer tubes, or the use of high grade alloys to construct the heat transfer tubes for the lower regions of the combustion zone.

SUMMARY OF THE INVENTION

The present invention is a process for combusting a hydrocarbon fuel comprising:

(a) introducing a feed stream comprising oxygen gas, an adsorbent for sulfur capture and the hydrocarbon fuel into a combustion zone;

(b) combusting the fuel in the presence of the oxygen gas to form gaseous combustion products and solid combustion products consisting of fly ash and bottom ash wherein the fly ash is entrained within the gaseous combustion products and wherein the solid combustion products contained within the combustion zone at any one time constitutes the solids inventory;

(c) withdrawing at least a portion of the gaseous combustion products containing the entrained fly ash through the top of the combustion zone; and (d) withdrawing at least a portion of the bottom ash through the bottom of the combustion zone;

(e) reducing the size of at least a portion of the bottom ash withdrawn in step (d);

(f) classifying the bottom ash from step (e) according to size;

(g) re-injecting a portion of the bottom ash classified in step (f) into the combustion zone; and (h) discarding the remaining portion of the bottom ash classified in step (f).

In a preferred embodiment of the present invention, the bottom ash withdrawn in step (d) is size classified prior to particle size reduction in step (e) in order to remove size fractions which do not contain significant amounts of unreacted fuel or adsorbent.

DETAILED DESCRIPTION OF THE INVENTION

Figure 1:
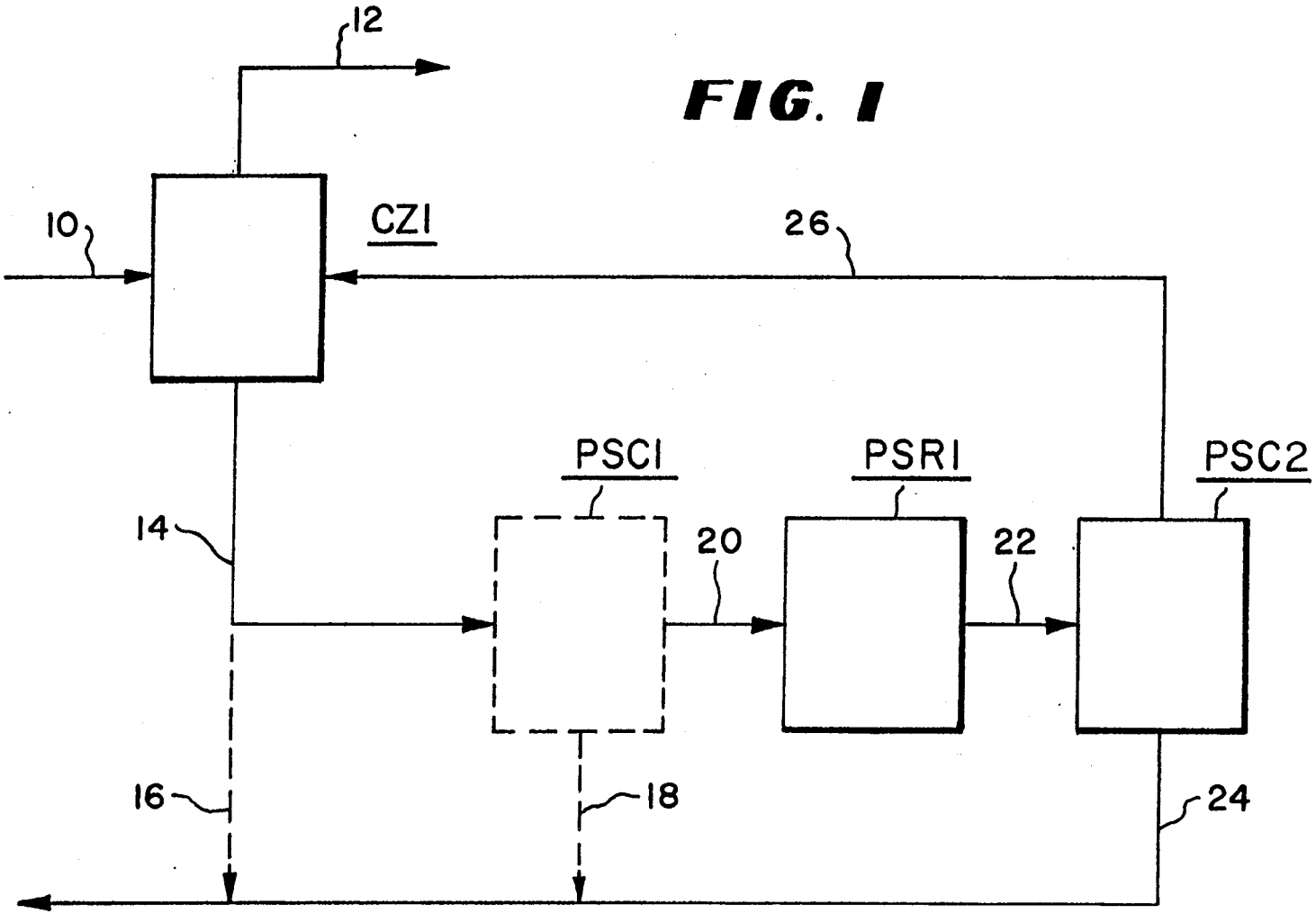
FIG. 1 is a schematic diagram depicting one general embodiment of the process of the present invention.

The process of the present invention is best illustrated with reference to a general embodiment thereof such as FIG. 1's embodiment. FIG. 1's process configuration consists of a combustion zone CZ1, a first particles size classifier PSC1, a particle size reducer PSR and a second particle size classifier PSC2. Referring now to FIG. 1, feed stream 10 comprising oxygen gas and a hydrocarbon fuel is introduced into combustion zone CZ1. The fuel is combusted in the presence of the oxygen gas to form gaseous combustion products and solid combustion products consisting of fly ash and bottom ash wherein the fly ash is entrained within the gaseous combustion products and wherein the solid combustion products contained within the combustion zone at any one time constitutes the solids inventory. At least a portion of the gaseous combustion products containing the entrained fly ash is withdrawn through the top of the combustion zone in line 12. Similarly, at least a portion of the bottom ash is withdrawn through the bottom of the combustion zone in line 14. As shown by the dotted lines in FIG. 1, a portion of line 14 can be optionally discarded in line 16 without regard to size or composition and/or optionally discarded in line 18 after being classified according to size in particle size classifier PSC1 in order to remove size fractions which do not contain significant amounts of unreacted fuel or adsorbent. The remaining withdrawn bottom ash in line 20 is subject to particle size reduction in particle size reducer PSR1 to produce an optimal particle size distribution. The effluent from PSR1 in line 22 is then classified according to size in particle size classifier PSC2. A portion of this classified ash is re-injected into the combustion zone in line 26 while the remaining portion is discarded in line 24.

The amount of bottom ash which can be reduced in particle size, classified and re-injected will depend on the design of the combustor facility. In principle, it is possible to process all bottom ash and recycle it to extinction. However, this mode requires that all ash be rejected from the system as fly ash. Consequently, the fly ash removal system must be designed to handle the entire load. This operating mode will maximize feedstock utilization for a facility. In addition, it could potentially reduce erosion in the combustion zone, since it reduces the population of larger particles in the combustion zone, which are known to be more erosive. In some cases, it may not be optimal to process all of the bottom ash. For some installations, the incremental savings in feedstock costs will not justify additional costs for increasing the capacity of the fly ash system to handle all the ash. In these cases, only a portion of the bottom ash should be processed. As shown in FIG. 1, there are three options for discarding a portion of the bottom ash before it is processed. In the first option, the total bottom ash stream is split without regard for particle size or composition as represented by line 16 in FIG. 1. The preferred second option is to classify the bottom ash according to size as represented by particle size classifier PSC1 in FIG. 1 in order to isolate those size fractions which have particular beneficial or detrimental characteristics. For example, it is known that larger bottom ash size fractions can be enriched in unreacted feedstocks. Only the beneficial fractions are then processed. Classifying the bottom ash stream prior to processing reduces the amount of inert material which is returned to the boiler. This step reduces heat losses associated with reheating the ash, decreases the burden on the fly ash removal system, and reduces the feed to the size reduction unit. A third option for discarding a portion of the bottom ash before it is processed would involve first discarding a portion of the bottom ash via the first option followed by discarding an additional portion of bottom ash via the second option.

An essential feature of the present invention is the ability to control the particle size distribution of the re-injected bottom ash. It is essential to recognize that the solid inventory in a circulating fluidized bed combustor is heterogeneous in terms of its size distribution and composition. The residence times for particles in the combustion system is very sensitive to the size of the particles. Since it is widely recognized that feedstock conversion will depend on the length of time that a particle stays in the combustor, it follows that feedstock utilization is also very sensitive to particle size. Consequently, it is essential that the particle size distribution of the bottom ash stream be altered prior to re-injection. In order to enhance the utilization of the larger particles, which are enriched in unreacted feedstocks, it is necessary to reduce their size so that their residence times will be increased when they are re-injected. However, it is essential that the bottom ash size not be reduced too much, since extremely small particles also have residence times too short for the complete utilization of the unreacted feedstocks. Due to the variation in residence time with size, there will generally be an optimal particle size distribution for the re-injected bottom ash which approximates the particle size distribution of the solid inventory in the combustion zone.

Many types of devices are known to achieve particle size reduction. Typical among these are hammermills, single- and double-roll crushers, and roller mills. The type of device which is most advantageous will depend on the nature of the bottom ash, and the desired size distribution of the product. Some devices, such as air-swept mills, are advantageous because they permit classification and size reduction of the ash to be completed in a single device, and are particularly useful for preventing excessive size reduction of the bottom ash.

The following examples are offered to demonstrate the efficacy of the present invention. These examples illustrate the benefits from recovering the unreacted fuel which is typically lost in the bottom ash, and the reduction in erosion which results from selectively removing coarser bed materials. All examples are based on data obtained from experimentation conducted at a commercial coal fired cogeneration facility in Stockton, Calif.

EXAMPLE 1

A 50 MWe circulating fluidized bed (CFB) boiler is fired with low sulfur (0.5 wt %) and low ash (6 wt %) bituminous coal. Limestone is fed to the combustor to capture sulfur oxides as calcium sulfate. Bottom ash and fly ash are withdrawn from the combustion zone with a portion of the fly ash re-injected into the combustion zone. The flowrates of feedstocks and ash, and amount of unburned carbon in the bottom ash are listed in Table 1. Lost fuel in the bottom ash in the three runs ranges from 52 to 143 lb/hr.

TABLE 1

Feedstock and ash flowrates for a 50 MWe CFB Facility (All flowrates in lb/hr)

| Run | Coal | Limestone | Fly Ash | Bottom Ash | Unreacted Fuel in Bottom Ash |
|---|---|---|---|---|---|
| 1 | 51900 | 2359 | 4610 | 1585 | 143 |
| 2 | 51700 | 2039 | 5283 | 1017 | 101 |
| 3 | 51400 | 1501 | 4794 | 626 | 52 |

The heterogeneous nature of the bottom ash from these runs is shown in Table 2, which summarizes the distribution of mass and unreacted fuel as a function of particle size. It shows that essentially all of the mass of bottom ash is comprised of particles greater than 90 μm in size, and most is larger than 425 μm. Furthermore, most of the unreacted fuel is present in particles ranging from 425 μm to 9500 μm. Although the finest particles have fairly high concentrations of unreacted fuel, their mass is fairly small.

TABLE 2

Bottom ash mass and unreacted fuel (UF) distribution as a function of particle size for a 50 MWe CFB Facility (All data in wt %)

| Run | 0–45 μm | 45–63 μm | 63–88 μm | 88–420 μm | 420–3350 μm | 3350–9500 μm | >9500 μm |
|---|---|---|---|---|---|---|---|
| 1 Mass | 1.1 | 1.1 | 0 | 41.6 | 16.2 | 25.5 | 14.5 |
| 1 UF | 40.6 | 10.3 | 0 | 2.6 | 17.7 | 16.4 | 3.3 |
| 2 Mass | 1.5 | 1.1 | 0 | 33.4 | 17.3 | 31.7 | 15 |
| 2 UF | ND | ND | 0 | 2.4 | 16.1 | 18 | 3.8 |
| 3 Mass | 1.4 | 1.2 | 0 | 33.0 | 18.1 | 28.0 | 18.3 |
| 3 UF | ND | ND | 0 | 3.5 | 13.2 | 17.91 | 3.2 |

ND: not determined

EXAMPLE 2

A representative sample of bottom ash from the combustor of Example 1 was processed without prescreening in a Williams Patent Crusher hammermill Model GP-1512 (TRADEMARK). The hammermill reduced the average particle size of the bottom ash from approximately 600 microns to between 100 and 200 microns. The amount of fines (passing U.S. Standard Sieve #200) increased from approximately 0 wt % in the bottom ash to between 16 wt % and 32 wt %. Top size of the material decreased from greater than three-quarter-inch to less than one-eighth-inch. As seen in the following Example 3, the size reduction achieved in these runs is sufficient to permit recovery of up to 85% of the unreacted fuel upon re-injection of the processed bottom ash.

EXAMPLE 3

A simulation of bottom ash re-injection was made for the combustor of Example 1, using the ash analysis from Run 1 of Example 1 and the results of the hammermill tests in Example 2. The calculations show the amount of fuel that could be recovered from the bottom ash. Calculations were made assuming that 50%, 75%, and 100% of the bottom ash is fed to the hammermill with no size classification prior to size reduction. Results are summarized in Table 3. The results show that up to 85% of the unreacted fuel can be recovered from the bottom ash. However, increasing recovery results in a greater fly ash flow rate.

TABLE 3

Improvements to facility per Run 1, as a function of bottom ash re-injection rate (All flowrates in lb/hr)

| Hamermill Feed | Net Fly Ash | Net Bottom Ash | Fuel Saved From Bottom Ash |
|---|---|---|---|
| 0 (0% of bottom ash) | 4610 | 1585 | 0 |
| 792 (50% of bottom ash) | 5403 | 792 | 61 (43%) |
| 1189 (75% of bottom ash) | 5006 | 396 | 92 (64%) |
| 1585 (100% of bottom ash) | 6195 | 0 | 122 (85%) |

EXAMPLE 4

A second series of calculations following the method of Example 3 was made for a system in which bottom ash is classified prior to being fed to the hammermill. For these cases, classification is assumed to be done with mechanical screens, although other processes are available. Classification allows the operator to remove particles with fuel contents that are not economical to recover. Results are presented for single screening, which rejects those bottom ash fraction passing through the sieve; and for double screening, which rejects bottom ash fractions either too fine or too coarse. The calculations were made using various U.S. Standard Sieve sizes, which are familiar in the art. The results show that size classification prior to size reduction can allow a substantial fraction of the unreacted fuel to be recovered without the large increase in fly ash flow rate, and with less total feed to the hammermill, as found in Example 3. Results are summarized in Table 4.

TABLE 4

Improvements to facility per Run 1, with screening of bottom ash prior to size reduction (All flowrates in lb/hr)

| Sieve Size(s) | Processed Ash Size (μm) | Hammermill Feed | Net Fly Ash | Net Bottom Ash | Fuel Saved from Bottom Ash |
|---|---|---|---|---|---|
| #170 | >88 | 1500 | 6160 | 35 | 114 (80%) |
| #400 | >420 | 890 | 5501 | 694 | 114 (80%) |
| #40 × ⅜-inch | 420 < X < 9500 | 661 | 5270 | 924 | 108 (76%) |

Results from the above Examples 3 and 4 show that the process of this invention allows unreacted fuel to be recovered from the bottom ash, which reduces operating costs. A second benefit of this invention is that it provides a means to purge larger particles from the combustor without depleting the bed inventory. This benefit is achieved by increasing the bed ash removal rate, and processing the bed ash to remove undesirable particles. The processing may involve simple size classification, or it may involve a combination of size selection and size reduction, depending on the nature of the combustor and the fuel. Removing the larger particles from the bed can reduce the erosion rates in the combustor, and decrease the potential for agglomeration. The following example illustrates potential reduction of erosion in the combustor.

EXAMPLE 5

Investigations have shown that erosivity, as measured by thickness loss, increases approximately linearly with particle size for the conditions of the study. These findings indicate that the relative erosivity of the bed material in a combustor will decrease as the amount of material withdrawn from the bed, processed for size reduction, and re-introduced into the bed increases. Using the data of Example 1, Run I as a base case, and the results of Example 2, the relative erosivity of the bed is estimated to decrease approximately 10% after processing.

The present invention has been described with reference to a general embodiment thereof. This embodiment should not be seen as a limitation of the scope of the present invention; the scope of such being ascertained by the following claims.

We claim:

1. A process for combusting a hydrocarbon fuel comprising:
   (a) introducing a feed stream comprising oxygen gas and the hydrocarbon fuel into a combustion zone;
   (b) combusting the fuel in the presence of the oxygen gas to form gaseous combustion products and solid combustion products consisting of fly ash and bottom ash wherein the fly ash is entrained within the gaseous combustion products and wherein the solid combustion products contained within the combustion zone at any one time constitutes the solids inventory;
   (c) withdrawing at least a portion of the gaseous combustion products containing the entrained fly ash through the top of the combustion zone; and
   (d) withdrawing at least a portion of the bottom ash through the bottom of the combustion zone;
   (e) reducing the size of at least a portion of the bottom ash withdrawn in step (d);
   (f) classifying the bottom ash from step (e) according to size;
   (g) re-injecting a portion of the bottom ash classified in step (f) into the combustion zone; and
   (h) discarding the remaining portion of the bottom ash classified in step (f) wherein the bottom ash withdrawn in step (d) is classified according to size prior to particle size reduction in step (e) in order to remove size fractions which do not have beneficial characteristics for re-injection into the combustion zone.

2. The process of claim 1 wherein the combustion zone is contained within a circulating fluidized bed combustion reactor.

3. The process of claim 1 wherein reduction of the particle size in step (e) is accomplished with a hammermill.

4. The process of claim 1 wherein at least a portion of the fly ash withdrawn in step (c) is recycled to the combustion zone.

* * * * *